United States Patent [19]

Iannucci

[11] 4,162,075

[45] Jul. 24, 1979

[54] BOARD GAME INVOLVING ELECTRIC UTILITY PLANT OPERATIONS AND FINANCE

[76] Inventor: Albert H. Iannucci, 1522 W. Atlanta Ave., Phoenix, Ariz. 85041

[21] Appl. No.: 902,831

[22] Filed: May 4, 1978

[51] Int. Cl.[2] ..... A63F 3/00

[52] U.S. Cl. ..... 273/256

[58] Field of Search ..... 273/254, 256

[56] References Cited

U.S. PATENT DOCUMENTS

| | | | |
|---|---|---|---|
| 2,026,082 | 12/1935 | Darrow | 273/256 |
| 2,178,330 | 10/1939 | Thomas | 273/254 |
| 2,239,779 | 9/1939 | Clark | 273/254 |
| 2,723,857 | 11/1955 | Miller | 273/254 |
| 2,746,756 | 9/1954 | Sitton | 273/254 |
| 2,952,461 | 9/1960 | Boulanger | 273/254 |
| 3,539,189 | 11/1970 | Shelton | 273/256 |
| 4,052,071 | 10/1977 | Siegfried | 273/254 |
| 4,052,072 | 10/1977 | Beal | 273/254 |

FOREIGN PATENT DOCUMENTS

| | | | |
|---|---|---|---|
| 2224988 | 3/1974 | France | 273/254 |
| 2263798 | 10/1975 | France | 273/254 |

*Primary Examiner*—Richard C. Pinkham
*Assistant Examiner*—R. Carl Moy
*Attorney, Agent, or Firm*—Herbert E. Haynes, Jr.

[57] ABSTRACT

A game involving the financial gains and losses associated with the operation of an electric utility plant. The game includes a playing board having three chance devices mounted thereon and having a plurality of playing sections marked off along its marginal portions and a special playing section marked off in a line across the board. The game also includes a plurality of Loss Report Cards, a plurality of Gain Report Cards, a plurality of Plant Down Report Cards, playing pieces and a Gain and Loss Score Card for each player with markers for scorekeeping purposes.

7 Claims, 6 Drawing Figures

BOARD GAME INVOLVING ELECTRIC UTILITY PLANT OPERATIONS AND FINANCE

BACKGROUND OF THE INVENTION

1. Field of the Invention

This invention relates to games and more particularly to a board game of the type sometimes referred to as being of the "Monopoly" game type.

2. Description of the Prior Art

The game of MONOPOLY which is disclosed in U.S. Pat. No. 2,026,082, issued in 1935, has met with a high degree of public acceptance and other board games of that same general type have evolved. One such board game has as its underlying theme, stock market transactions, and another deals with the borrowing and lending of money. So far as is known to me, there is no game of this type which involves the operation and finances of an electric utility plant. The present invention is predicated on the belief that a board game which relates to utility plant operations and finances will be entertaining, instructive in basic power plant operations, instructive in basic finances, and will meet with public acceptance.

SUMMARY OF THE INVENTION

In accordance with the present invention, a new and useful board game is disclosed as being designed to simulate the actual operations of electric utility plants and the financial gains and losses associated with such operations, with the financial aspects being employed for scorekeeping purposes so that the game, in addition to being entertaining, will be instructive as to the basic concepts of electric utility plant operations and finances.

The game includes a four-sided board of appropriate dimensions and having a playing surface with each marginal or side portion of the playing surface, marked off into a plurality of individual sections, with the sections of each marginal portion being in alignment. Some of the marginally arranged sections are marked off to indicate the revenues derived by power plant generation with others randomly arranged and marked: Control Alarm Board, Gain Report, and Loss Report.

A plurality of special sections are marked off in a line across the playing surface of the board with these special sections marked in a numerical progression to indicate plant Days Down. A Start Up section is interposed between the numerically low end of the special sections and a point intermediate the ends of one of the marginal portions.

The playing surface of the board is further marked off in three card stacking areas which are marked: Loss Report, Gain Report, and Plant Down Report and, the board has three spinner type chance devices mounted thereon for controlling movements of the game.

The game further includes a plurality of Gain Report Cards, a plurality of Loss Report Cards, a plurality of Plant Down Report Cards, a playing piece for each of the players and Gain and Loss Score Cards for each of the players, with a plurality of coins or markers employed for scorekeeping purposes.

Accordingly, it is an object of the present invention to provide a new and useful board game.

Another object of the present invention is to provide a new and useful board game which is educational and entertaining.

Another object of the present invention is to provide a new and useful board game which involves the financial gains and losses associated with the operation of an electric utility plant.

Another object of the present invention is to provide a board game of the above described character which simulates the operations of the electric utility plant and the financial gains and losses associated with such operations, and bases the scorekeeping of the game on the financial aspects of utility plant operations.

Still another object of the present invention is to provide a new and useful board game of the above described type which includes a four-sided playing board having a plurality of appropriately identified marginally arranged playing sections, and an array of special playing sections arranged in a line across the board, with the board having three chance operated devices mounted thereon for controlling play of the game, a plurality of Gain Report Cards, a plurality of Loss Report Cards, a plurality of Plant Down Report Cards, a playing piece for each player, a Gain and Loss Score Card for each player, and a plurality of markers which are employed for scorekeeping purposes.

The foregoing and other objects of the present invention, as well as the invention itself, may be more fully understood from the following description when read in conjunction with the accompanying drawings.

DESCRIPTION OF THE PREFERRED EMBODIMENT

Figure 1:
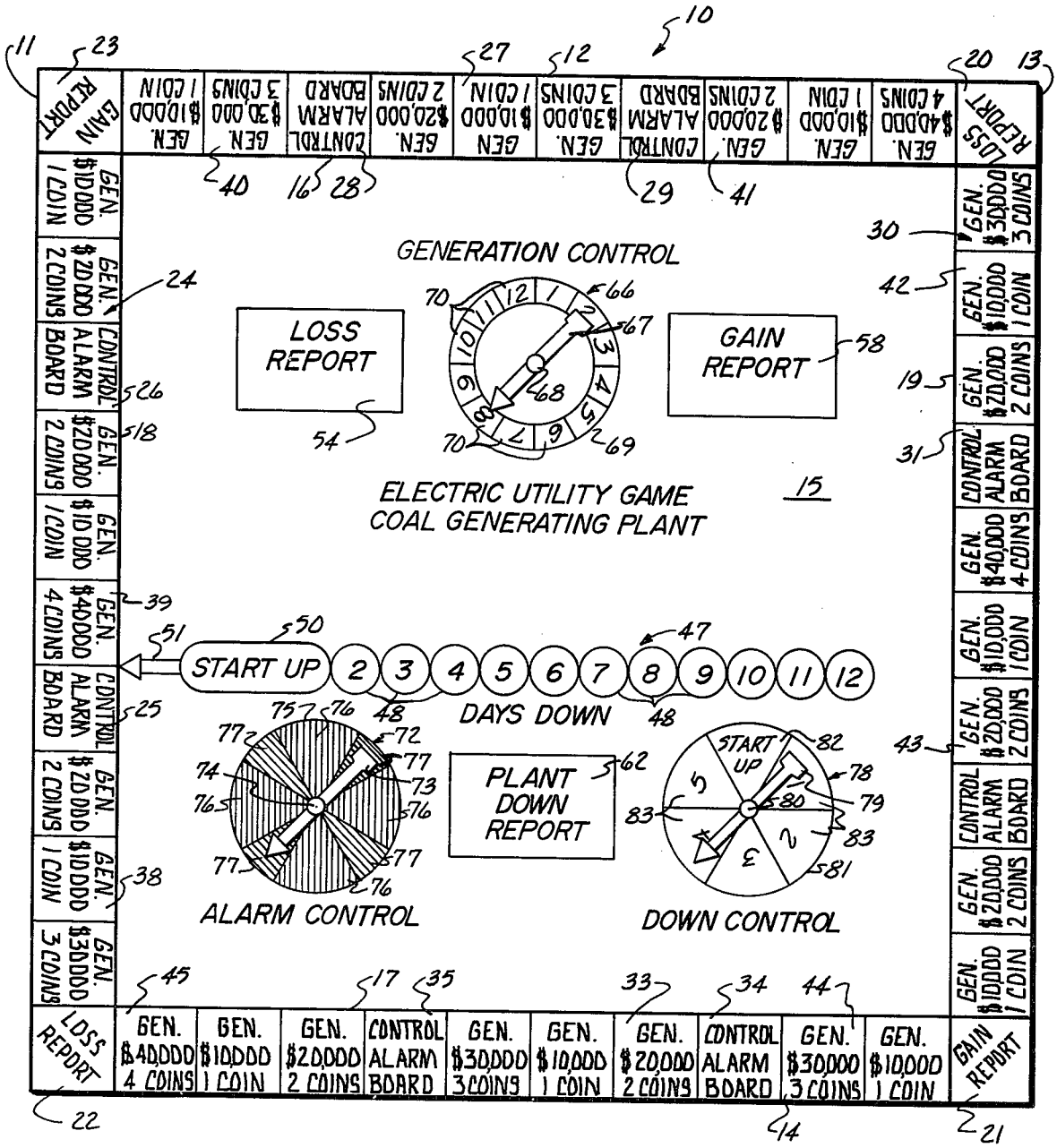
FIG. 1 is a plan view of the playing board of the game of the present invention.

Referring more particularly to the drawings, FIG. 1 illustrates a playing board which is indicated generally by the reference numeral 10. The board 10 may be fabricated of any suitable material, with a good grade of cardboard being preferred as is customary in games of the instant type. The board 10 is preferrably of square configuration having side edges 11, 12, 13 and 14 and a playing surface 15. Extending from side edge 11 to side edge 13 are inner lines 16 and 17 which are each spaced inwardly from a different one of the side edges 12 and 14 and are parallel to those side edges. Additional inner lines 18 and 19 extend between side edges 12 and 14, with the inner lines 18 and 19 being spaced inwardly from different ones of the side edges 11 and 13 and parallel with respect thereto. Side edges 12 and 13 along with inner lines 16 and 19 define a corner square 20 which is identified as "Loss Report". Side edges 13 and 14 along with inner lines 17 and 18 define a corner square 21 which is identified as "Gain Report". Side edges 11 and 14 along with inner lines 17 and 18 define another corner square 22 which is identified as "Loss Report", and a fourth corner square 23 is identified as "Gain Report" and is defined by side edges 11 and 12 in conjunction with inner lines 16 and 18.

The area between side edge 11 and inner line 18 may be defined as a first marginal portion 24 and is divided into ten equally sized squares, with two of those squares being identified at 25 and 26 and identically marked with the indicia "Alarm Control Board". The area between side edge 12 and inner line 16 may be defined as a second marginal portion 27 and is divided into ten equally sized squares with two of those squares being identified at 28 and 29 and marked to read, "Control Alarm Board". Further, the area between side edge 13 and inner line 19 may be defined as the third marginal portion and is divided into ten equally sized squares with two of those squares marked with the indicia "Control Alarm Board" and identified with the reference numerals 31 and 32. Likewise, the area between side edge 14 and inner line 17 is defined as the fourth marginal portion 33 and is divided into ten equally sized squares two of which are identified by the reference numerals 34 and 35 and are marked with the indicia "Control Alarm Board". The remaining squares in each of the marginal portions 24, 27, 30 and 33 are identified to indicate revenues earned as a result of electric utility plant power generation. For example: the playing squares 38 and 39 in marginal portion 24 are identified as "Generate, $10,000–1 coin" and "Generate, $40,000–4 coins", respectively, the squares 40 and 41 in marginal portion 27 are identified as "Generate, $30,000–3 coins" and "Generate, $20,000–2 coins", respectively. Likewise, for example, the squares 42 and 43 of marginal portion 30 are identified as "Generate, $10,000–1 coin" and "Generate, $20,000–2 coins", respectively, and the squares 44 and 45 of the fourth marginal portion 33 are identified as "Generate, $30,000–3 coins" and "Generate, $40,000–4 coins", respectively.

In addition to the above described playing squares disposed in the four corners of the playing board 10 and the squares located in each of the marginal portions 24, 27, 30 and 33, an aligned array of special playing areas are broadly identified as "Days Down" as will hereinafter be described in detail, and those areas are arranged in a line across the board 10, with those special playing areas being identified in their entirety by the reference numeral 47. The special playing array or portion 47 includes a plurality of individually encircled sections 48, it being noted that other geometric configurations could be used, with each section being marked with a different numeral so as to form a numerical progression which increases in numerical value from left to right as seen in FIG. 1.

At the numerically low end of the special playing portion 47, an oblong playing area 50 is provided, with that area 50 being marked as "Start Up". The Start Up area 50 is connected by means of an arrow 51 to a point substantially intermediate the opposite ends of the first marginal portion 24.

Figure 4:
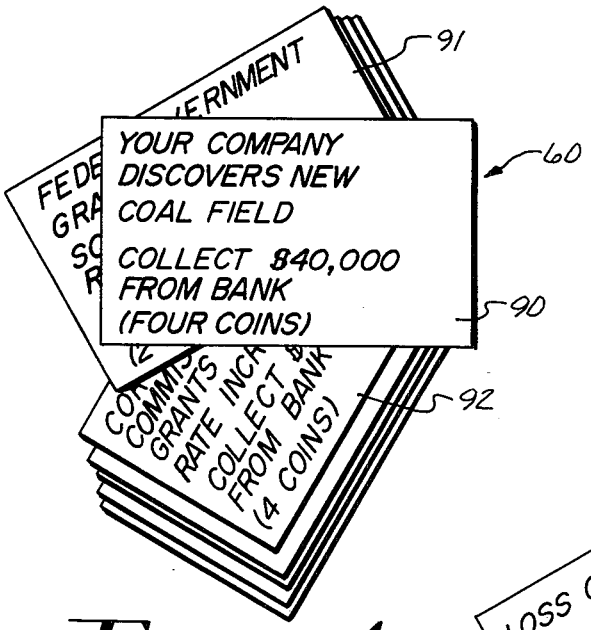
FIG. 4 is a plan view of a randomly arranged stack of Gain Report Cards used in playing the game of the present invention.
Figure 5:
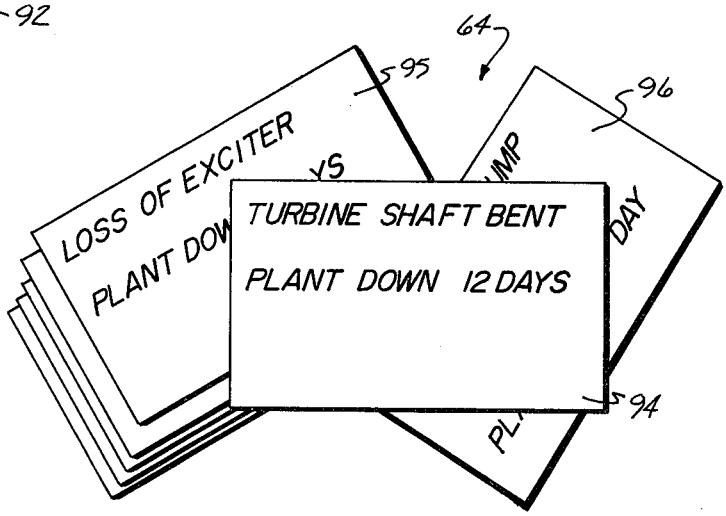
FIG. 5 is a plan view of a randomly arranged stack of Plant Down Report Cards used in playing the game of the present invention.

A first card placement area 54 is marked on the board 10 with that area being identified as "Loss Report", with it being intended that the area 54 be employed for placement of a stacked plurality of Loss Report Cards 56 thereon, as will hereinafter be described in detail, with those Loss Report Cards 56 being illustrated in FIG. 3. A second card placement area 58 is marked on the board 10 and is identified as "Gain Report", it is intended that the second card placement area 58 be used for placement of a stacked plurality of Gain Report Cards 60 which are shown in FIG. 4 and will hereinafter be described in detail. A third card placement area 62 is marked on the board 10 and is identified as "Plant Down Report" with it being intended that this third area 62 be used for placement of a stacked plurality of Plant Down Report Cards 64, as seen in FIG. 5, and as will be described.

A first chance device 66 is identified generally as "Generation Control", and is mounted on the board 10. The first chance device 66 includes a spinner 67 in the form of an arrow which is mounted intermediate its opposite ends on a suitable pivot bearing 68 which is mounted to extend normally from the board 10. The spinner arrow 67 is spinnable in a plane above and parallel to the board 10 and overlays a ring-shaped area 69 marked on the board 10 so as to be coaxial with the pivot bearing, with that area 69 divided into 12 sections 70 with the sections 70 marked with numerals that progress from 1 to 12. Thus, spinning of the arrow 67 will cause it to revolve about the pivot bearing 68 until it comes to rest above one of the numerically marked sections 70 of the ring-shaped area 69.

A second chance device 72 is identified generally as "Alarm Control" and is mounted on the board 10. The second chance device 72 includes a spinner arrow 73 which is mounted intermediate its opposite ends on a suitable pivot bearing 74 carried in the board 10 so as to extend normally therefrom. The spinner arrow 73 is spinnable in a plane above the board 10 and is parallel thereto, and overlays a circular area 75 which is coaxial with the pivot bearing and is divided into eight pie-shaped segments which are alternately identified with two colors such as red and green to provide red segments 76 alternately arranged with green segments 77. Spinning of the spinner arrow 73 will cause it to revolve on the pivot bearing 74 until it comes to rest above one of the red or green segments 76 and 77, respectively, of the circular area 75.

A third chance device 78 is identified generally as "Down Control" and is mounted on the board 10. The third chance device 78 includes a spinner arrow 79 which is carried intermediate its opposite ends on a suitable pivot bearing 80 carried in the board 10 so as to normally extend therefrom. The spinner arrow 79 overlays a circular area 81 which is coaxial with the pivot bearing and is divided into six pie-shaped segments with one of those segments 82 being marked "Start Up" and the other segments 83 being marked with numerals progressing from one to five. Therefore, spinning of the arrow 78 will cause it to spin in a plane above and parallel to the surface of the board 10 on the pivot bearing until it comes to rest over one of the segments 82 or 83 as marked in the circular area 81.

Figure 2:
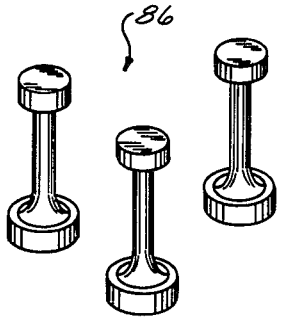
FIG. 2 is a perspective view of a group of playing pieces suitable for use in the game of the present invention.

Referring now to FIG. 2 wherein a group of playing pieces are shown with the group being identified in their entirety by the reference numeral 86. Although only three playing pieces 86 are shown and those pieces are illustrated as being identically configured it will be understood that the number may be varied, the configurations may vary and pieces 86 may be of different colors so as to be able to be distinguished from one another.

Figure 3:
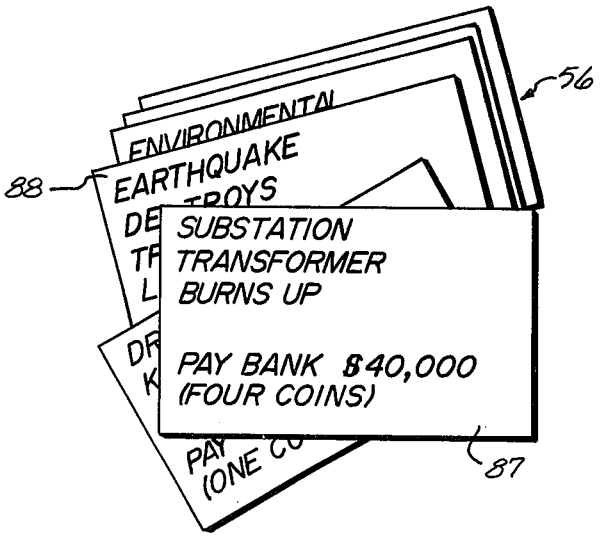
FIG. 3 is a plan view of a randomly arranged stack of Loss Report Cards used in the game of the present invention.

As hereinbefore mentioned, FIG. 3 shows a plurality of Loss Report Cards 56, which are intended to be placed in stacked condition on the area 54 of the game board 10. The Loss Report Cards 56 may be in any suitable quantity such as 20, and will indicate various conditions which result in financial losses for the electric utility company. Thus, purely by way of example, the top card, which is designated 87, would identify the financial loss condition as "Sub-station Transformer Burns Up" and also indicates the amount of financial loss as being $40,000–4 coins. Again, by way of example, the third card 88 in the stack of Loss Report Cards 86 identifies the financial loss as "Earthquake Destroys Transmission Lines", and although not shown, indicates the financial loss as being $20,000–2 coins. Further examples of such cards which are not shown may be "Environmental Protection Agency Sues You", "Customer Owing Big Electric Bill Declares Bankruptcy", and the like.

The plurality of Gain Report Cards 60 which are intended to be placed in stacked condition in the area 58 of the board 10, may be of any suitable number, such as 20, and will indicate various conditions which result in financial gains for the electric utility company. Therefore, by way of example, the top card which is designated 90, identifies a financial gain condition as "Your Company Discovers New Coal Field", and indicates the gain as being $40,000–4 coins. Again, by way of example, the second card 91 in the stack 60, although not completely shown, identifies the financial gain condition as being "Federal Government Grants You Solar Energy Research Contract" and indicates the gain as being $20,000–2 coins. The third card 92 (not completely shown) indicates the gain condition as being "Corporation Commission Grants You a Rate Increase" and indicates the amount of the gain as being $40,000–4 coins.

FIG. 5 shows the hereinbefore mentioned plurality of Plant Down Report Cards 64 which are intended to be placed in a stacked condition on the area 62 of the game board 10. The Plant Down Report Cards may be of any suitable number such as 20, and will indicate various conditions which cause shutdown of the electric utility company, and also indicate the number of days that the plant will be shut down. Thus, for example, the top card which is indicated as 94, indicates the cause of the plant shutdown as being "Turbine Shaft Bent" and indicates the shutdown period for this condition as being 12 days. Another plant shutdown Report Card 95 in the stack 64 may indicate the plant shutdown condition as resulting from "Loss of Exciter" with a twelve day shutdown resulting. A further example, although not completely shown, is indicated on the card 96 as being "Boiler-Feed Pump Failure" with a resulting nine day plant shutdown.

Figure 6:
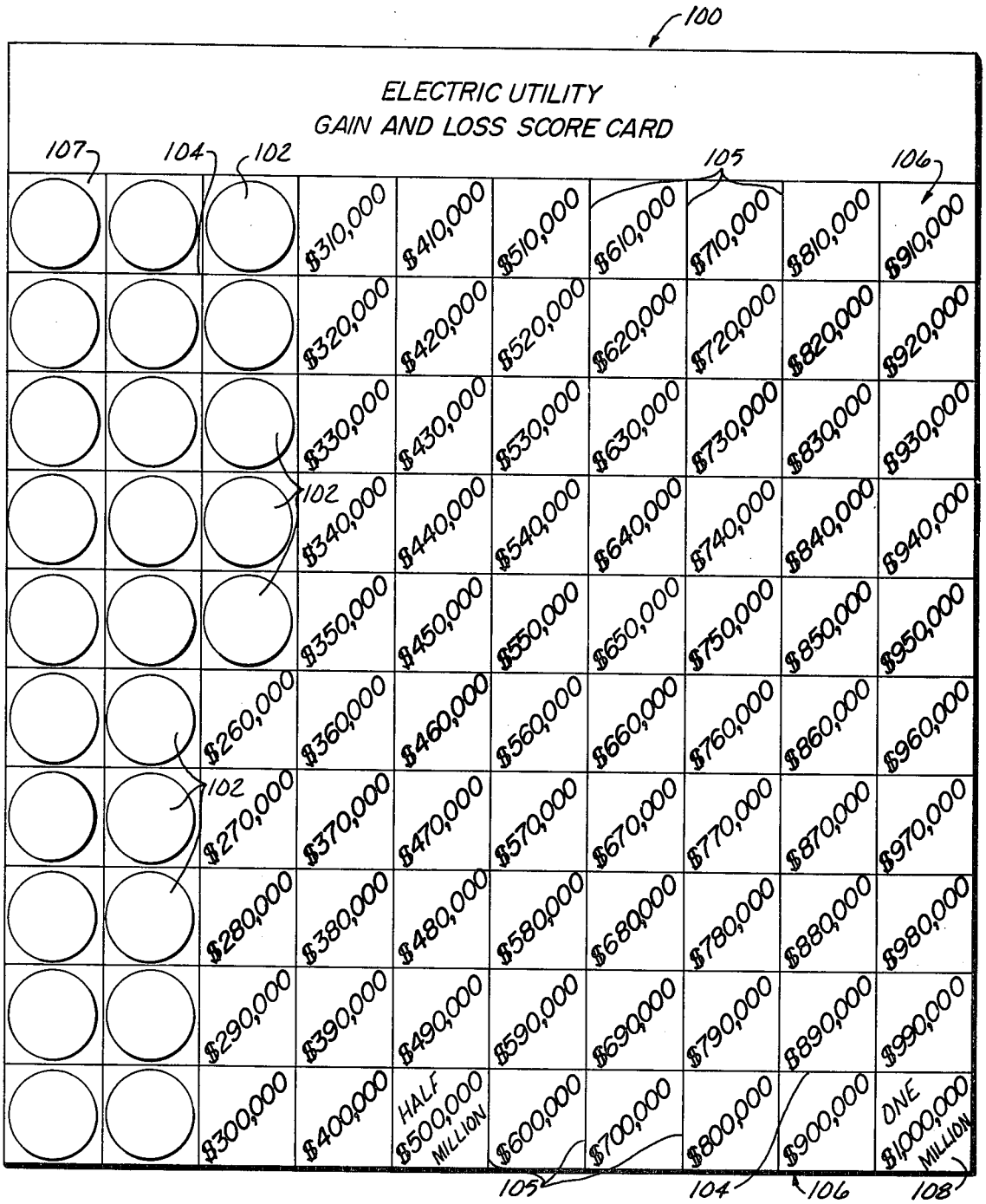
FIG. 6 is a plan view of a typical one of the Gain and Loss Score Cards employed in the game of the present invention and also illustrates the markers used for scorekeeping purposes.
Figure 6:
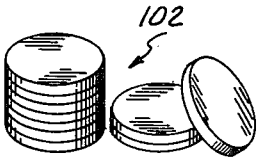

Referring now to FIG. 6 wherein a Gain and Loss Scorekeeping means is illustrated in the form of a scorecard which is designated generally by the reference numeral 100, and a plurality of coins or markers 102 which are used for scorekeeping purposes. It will be understood that each player will be supplied with one of the scorecards 100 and with enough coins 102 to completely cover each of the squares of the board as will hereinafter be described in detail.

The financial Gain and Loss Scorecard 100 is provided with a plurality of horizontally disposed spacedly arranged parallel lines 104 and a plurality of vertically disposed spaced arranged lines 105. The lines 104 and 105 are marked on the card 100 so as to define a plurality of squares that are laid out in checkerboard fashion and are indicated generally by the reference numeral 106. Each of the squares 106 is marked with a monetary amount which progresses in increments of $10,000 from the top left hand square 107 downwardly through the successive columns to the lower right hand square 108. As will become apparent as this description progresses, each of the coins or markers 102 is assigned a monetary value of $10,000 thus, when a player has earned that amount during play of the game he may place one of the coins 102 on the appropriate one of the squares 106 which will keep track of the sum of the player's earnings.

Rules of the Game and Method of Play

It will be understood that the rules of the game and method of play are subject to variation within a relatively wide range with the principle factor being that each facet of the game is related to the operation of electric utility companies and those operations in turn are related to financial gains and losses.

A suggested set of rules and method of play embodying the above described principle is set forth below.

I.

It is intended that the instant game be played by a minimum of two players with the maximum number being limited only by the game equipment available and the playing space. Each player selects one of the playing pieces 86 and is given one of the financial Gain and Loss Scorecards 100 with enough coins 102 to cover each of the squares 106 thereof. An alternative to each player acting as his own banker would be to select one of the players as the game banker who would give and receive the coins 102 as determined by the playing of the game.

II.

Each player is given 10 coins ($100,000) and play begins at the oblong playing area 50 which is marked "Start Up". A player spins the spinner arrow 67 of the chance device 66 which is indicated generally as "Generation Control". When the arrow 67 comes to rest over one of the segments 70 of the chance device 66, the numeral indicated in that particular one of the sections determines the movement of his playing piece. The playing piece will be moved in the direction of the arrow 51 and will proceed in a clockwise direction through the first marginal section 24 into the second marginal section 27.

III.

If the player lands on the corner square 23, he takes the top card from the stacked "Gain Report Cards" 60 which, as hereinbefore described, indicates the condition responsible for his plant receiving financial gain and indicates the amount of that financial gain. In accordance with the amount of financial gain, the player places the appropriate number of coins 102 on his Scorecard 100. The player then returns the drawn card to the bottom of the stack 60.

IV.

If the player lands on the playing square 40 of the second marginal section 27, or any other similarly identified playing section, the indicia thereon indicates a revenue amount earned as a result of normal plant electric power generation, which in the case of playing square 40, is $30,000 and this entitles the player to place three of the coins 102 on his Gain and Loss Scorecard 100.

V.

If the player should land on the playing square 28, or any of the other squares which are marked "Control Alarm Board", this indicates that the Control Board or Panel in the utility plant is producing an alarm signal indicative of an equipment problem or malfunction. The player, after landing on such a playing square, will spin the arrow 73 of the chance device 72 which is marked generally as "Alarm Control". If the arrow 73 comes to rest over one of the green segments 77, the equipment problem or malfunction was of a minor nature and the player spins again. If, on the other hand, the arrow 73 comes to rest on one of the red segments 77, the player takes the top card from the stack of "Plant Down Report Cards" 64 from which he learns the nature of the equipment problem and the number of days that it will take to overcome that problem. For example, if the player should draw the previously described card 94, the problem is a "Bent Turbine Shaft" and the resulting days down are twelve. The player then moves his playing piece to the one of the encircled playing sections 48 marked with the numeral 12 in the special playing area 47 generally designated as "Days Down".

VI.

Once a player has landed in the "Days Down" special playing area 47, he will, upon the occurrence of each of his subsequent playing turns, spin the arrow 79 of the chance device 78 which is designated generally as "Down Control". If the arrow 79 lands on the segment 82 which is marked "Start Up", he will move his playing piece to the Start Up playing section or area 50, and can resume normal play upon the occurrence of his next playing turn. If, on the other hand, the arrow 79 comes to rest on one of the segments 83, he moves his playing piece in accordance with the numerical value indicated in the particular segment 83 over which the arrow 79 comes to rest. For example, if the arrow 79 lands on the segment with the numeral "3" marked therein, he will move his playing piece three places closer to the Start Up playing area 50, and will repeat this sequence at each of his subsequent playing turns until he reaches the area 50 whereupon he can resume normal play.

VII.

When a player lands on either of the corner playing areas 20 or 22, he will take the top card from the stacked Loss Report Cards 56. That card will inform the player of the condition which produced a financial loss and the amount of the loss. For example, if a player draws the previously described card 87, he learns that a burned up substation transformer will cost his utility plant $40,000, thus, he removes four of the coins 102 from his Gain and Loss Scorecard 100, returns the drawn card 87 to the bottom of the stack 57 and resumes normal play upon the occurrence of his next playing turn.

VIII.

Play of the game continues in the manner described above and will end when one of the players has completely covered his Gain and Loss Scorecard 100 with coins 102 which indicates that his electric utility company has earned $1,000,000.00. It will be noted that individual players will be eliminated if their financial balance falls to zero.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A board game relating to the financial gains and losses associated with the operating of electric utility plants, said board game comprising:

(a) a playing board having four side edges and a playing surface;

(b) a plurality of marginally disposed playing sections arranged in alignment along each side edge of said board, at least one of said playing sections displaying a symbol indicative of a financial gain report, at least one of said playing sections displaying a symbol indicative of a financial loss report, at least one of said playing sections displaying a symbol indicative of a control board alarm, and the remaining ones of said playing sections displaying symbols indicative of various financial gains resulting from electric power generation;

(c) a plurality of special playing sections arranged in a line across the playing surface of said board such that none of said special playing sections is contiguous with any said marginally disposed playing sections, each of said special playing sections displaying a different symbol indicative of a number of days down, with those symbols arranged in a numerical progression;

(d) a start up playing section interposed between, and contiguous with the numerically low end of said plurality of special playing sections and at least one of said marginally disposed playing sections that are arranged along one of the side edges of said board;

(e) a plurality of financial gain report cards each bearing a symbol corresponding to the symbol on said financial gain report playing sections;

(f) a plurality of financial loss report cards each bearing a symbol corresponding to the symbol on said financial loss report playing sections;

(g) a plurality of plant down report cards each identifying a different type of plant alarm condition and the number of days down resulting from that alarm condition;

(h) a plurality of playing pieces movable on said board;

(i) a first chance device mounted on said board for determining the number of said marginally disposed playing sections over which said playing pieces are movable;

(j) a second chance device mounted on said board for determining if a playing piece is to be moved onto said special playing section;

(k) a third chance device mounted on said board for determining the number of said special playing sections over which said playing pieces are movable; and (l) at least one financial gain and loss scorekeeping means for recording the gains and losses.

2. A board game as claimed in claim 1 wherein the playing surface of said playing board includes:

(a) a first area marked thereon for receiving said plurality of financial gain report cards in a stacked formation;

(b) a second area marked thereon for receiving said plurality of financial loss report cards in a stacked formation; and (c) a third area marked thereon for receiving said plurality of plant down report cards in a stacked formation.

3. A board game as claimed in claim 1 wherein said first chance device comprises:

(a) a pivot bearing mounted to extend normally from the playing surface of said board;

(b) a spinner arrow mounted intermediate its opposite ends on said pivot bearing so as to be spinnable in a plane above and parallel to the playing surface of said board; and (c) a ring-shaped area marked on the playing surface of said board and coaxially disposed with respect to said pivot bearing, said ring-shaped area divided into a plurality of sections each displaying a different numerical symbol.

4. A board game as claimed in claim 1 wherein said second chance device comprises:

(a) a pivot bearing mounted to extend normally from the playing surface of said board;

(b) a spinner arrow mounted intermediate its opposite ends on said pivot bearing so as to be spinnable in a plane above and parallel to the playing surface of said board; and (c) a circular area marked on the playing surface of said board and coaxially disposed with respect to said pivot bearing, said circular area divided in a plurality of alternately identified segments.

5. A board game as claimed in claim 1 wherein said third chance device comprises:

(a) a pivot bearing mounted to extend normally from the playing surface of said board;

(b) a spinner arrow mounted intermediate its opposite ends on said pivot bearing so as to be spinnable in a plane above and parallel to the playing surface of said board; and (c) a circular area marked on the playing surface of said board and coaxially disposed with respect to said pivot bearing, said circular area divided into a plurality of segments each displaying a different symbol for indicating the movements of said playing pieces on said special playing sections.

6. A board game as claimed in claim 1 wherein said financial gain and loss scorekeeping means comprises:

(a) a card having a plurality of individual areas marked thereon, each of said areas displaying a symbol indicative of a different monetary value; and (b) a plurality of markers each placeable on one of the areas marked on said card.

7. A game board as claimed in claim 1 wherein said financial gain and loss scorekeeping means comprises:

(a) a gain and loss scorecard having a plurality of squares marked thereon and arranged in a checkerboard formation, each of said squares displaying a symbol indicative of a different monetary amount with the symbols arranged so that the indicated monetary amounts increase incrementally from the top left hand one of said squares to the lower right hand one of said squares; and (b) a plurality of coins each placeable on one of the squares marked on said card.

* * * * *